US006739430B2

(12) United States Patent
Hill

(10) Patent No.: US 6,739,430 B2
(45) Date of Patent: May 25, 2004

(54) VARIABLE-INCLINE RAMP SYSTEM

(76) Inventor: Robert Hill, 1305-6th Avenue, New Westminster, British Columbia (CA), V3M 2C3

( * ) Notice: Subject to any disclaimer, the term of this patent is extended or adjusted under 35 U.S.C. 154(b) by 137 days.

(21) Appl. No.: 10/072,736

(22) Filed: Feb. 5, 2002

(65) Prior Publication Data

US 2003/0146055 A1 Aug. 7, 2003

(30) Foreign Application Priority Data

Jan. 16, 2002 (CA) ..... 2367735

(51) Int. Cl.[7] ..... B66B 9/06; B66B 9/193
(52) U.S. Cl. ..... 187/245; 187/200
(58) Field of Search ..... 187/200, 201, 187/245, 251, 254; 182/141, 142, 144; 414/139.5, 393, 399, 595

(56) References Cited

U.S. PATENT DOCUMENTS 159,233 A * 1/1875 Walters ..... 187/201
2,563,260 A * 8/1951 Miller ..... 187/201
2,876,919 A * 3/1959 True et al. ..... 414/139.5
3,168,937 A * 2/1965 Redford ..... 187/245
3,592,294 A * 7/1971 Allen ..... 187/245
3,891,062 A * 6/1975 Geneste ..... 187/245
4,438,830 A * 3/1984 Born ..... 187/201
4,595,313 A * 6/1986 Kotke ..... 187/200
6,105,726 A 8/2000 Taylor et al. ..... 187/201
6,109,854 A * 8/2000 Thompson et al. ..... 187/245

* cited by examiner

*Primary Examiner*—James W. Keenan
*Assistant Examiner*—Thuy V. Tran
(74) *Attorney, Agent, or Firm*—Oyen Wiggs Green & Mutala

(57) ABSTRACT

The invention provides a ramp system for transporting objects from a lower site to an upper site and vice versa while keeping the object in a generally horizontal, or upright, orientation when the object is moved up a variable incline. Two rails are provided between the upper and lower site, and a carriage is provided with wheels to allow it to move along the rails. A plurality of cables extend from the carriage to the upper site and to the lower site, the cables passing through pulleys affixed to the carriage, in an arrangement which causes the front portion of the carriage to be cantilevered over the rails, thus keeping a horizontal orientation notwithstanding the incline of the ramp. In a preferred embodiment, the system is implemented in a marine environment between a floating dock and a fixed pier.

10 Claims, 3 Drawing Sheets

VARIABLE-INCLINE RAMP SYSTEM

TECHNICAL FIELD

The present invention relates to systems for transporting material and people up and down ramps, and more particularly to systems for transporting material and people up and down a variably-inclinable ramp in a carriage configured to maintain a generally horizontal orientation.

BACKGROUND

Ramps are used to transport material between two sites having different elevations. It is well known, for example, to use a ramp to move heavy articles from the ground into a truck.

It is also well known to move people up and down ramps. In particular, ramps are often employed to move people in wheelchairs and other similar devices between two sites having different elevations. Such "wheelchair ramps" are ubiquitous in our society nowadays, and such ramps are indeed often mandated by modern building codes to ease the mobility of those in wheelchairs and generally to assist in the transportation of people using such devices.

Despite the fact that wheelchair ramps and other ramps are now commonplace, however, those in wheelchairs still face difficulties traversing some of these ramps. In some instances, a ramp might be too steep to allow the wheelchair-bound person to push the wheelchair up the ramp alone without assistance. Such assistance might be provided by another person, but it is also common to provide such assistance by means of some motorized system. In many such motorized systems, a carriage is provided which can accept the wheelchair, and which can then be moved from the lower end of the ramp to the upper end (and, of course, vice versa). It is not uncommon for such motorized systems to be constructed to allow a person to remain in their wheelchair, but if this is the case, it is much preferred that the wheelchair maintain a typical, generally horizontal orientation.

While it is relatively straightforward to provide an effective motorized ramp system to transport a wheelchair in a generally horizontal orientation where the degree of incline between a lower site and an upper site is invariable, it is much more difficult to provide a system which will maintain this generally horizontal orientation in a situation where the incline can vary. One very common such situation is that which will be familiar to those who live in marine environments. It is very common to have variably-inclinable ramps extending between the shore (or a fixed dock extending out from the shore) and a floating dock situated upon the surface of the water.

It should be readily understood that the angle of incline of such a ramp, if the ramp is of a fixed length, varies according to the relative elevations between the upper, fixed dock, and the lower, floating dock. The difference in relative elevations, in turn, varies depending upon the water level. In many marine environments (for example, on the ocean), where the action of tides can cause a significant variation in water levels, the degree of inclination of such ramps can pass through a wide range. At low tide, the ramp will be steep, and accordingly difficult for a person in a wheelchair to traverse.

Further, it might be dangerous for the wheelchair-bound person to attempt to traverse a ramp in a marine environment when surrounding environmental conditions are poor. A carriage for securing the wheelchair is therefore desirable.

Attempts have been made to construct systems which can maintain some object in a generally horizontal, or upright, orientation when the object is moved up a variable incline. Indeed, an attempt has been made to describe such a system which might have application in a marine environment. U.S. Pat. No. 6,105,726 discloses a variable-incline ramp system for maintaining a vehicle in a horizontal orientation, and that patent states therein that the system might be employed in a marine environment. This system uses a set of four rails along which are able to move four wheels attached to a platform. It is unlikely that this system would be realistically employed in a marine environment, however. First, it could not be easily retrofitted onto an existing dock. Second, the platform of the system does not permit a wheelchair to be safely contained within a carriage to prevent the wheelchair from slipping off the ramp. Structural limitations of this system also prevent regular, non-wheelchair bound persons from using the ramp in a typical fashion.

What remains necessary, accordingly, is a ramp system for allowing the movement of people and materials through an incline while maintaining them in their generally horizontal or upright orientation, notwithstanding the variable degree of incline. The present invention is directed to such a system.

SUMMARY OF INVENTION

The present invention provides a ramp system for transporting material between a first site and a second site, the first site having a lower elevation than the second site, the system comprising first and second rails extending between the first and second sites, the first and second rails pivotally attached at one end to the second site at first and second lower attachment points respectively, each rail bearing an upwardly extending support member near its opposite end. A carriage is provided for carrying the material, the carriage having a frame comprising a front portion, a lower rear portion and an upper rear portion. A plurality of wheels are attached to the lower rear portion of the carriage for engaging the rails. A first upper pulley is attached to the upper rear portion of the frame on one side thereof, and a second upper pulley is attached to the upper rear portion of the frame on the opposite side thereof. A first lower pulley is attached to the lower rear portion of the frame on one side thereof, and a second lower pulley is attached to the lower rear portion of the frame on the opposite side thereof.

A first cable is attached at one end to a first upper attachment point on the second site, the first upper attachment point located at a higher elevation than the first lower attachment point, and the first cable is attached at an opposite end to the bottom portion of the support member on the first rail. The first cable extends from the first upper attachment point over the first upper pulley and under the first lower pulley. A second cable is attached to a second upper attachment point on the second site, the second upper attachment point located at a higher elevation than the second lower attachment point. The second cable is attached at an opposite end to the bottom portion of the support member on the second rail. The second cable extends from the second upper attachment point over the second upper pulley and under the second lower pulley. Also provided are means for providing motive force to the carriage to move it up and down the rails between the said first and second sites.

BRIEF DESCRIPTION OF DRAWINGS

In drawings which illustrate a specific embodiment of the invention, but which should not be construed as restricting the spirit or scope of the invention in any way.

DESCRIPTION

Figure 1:
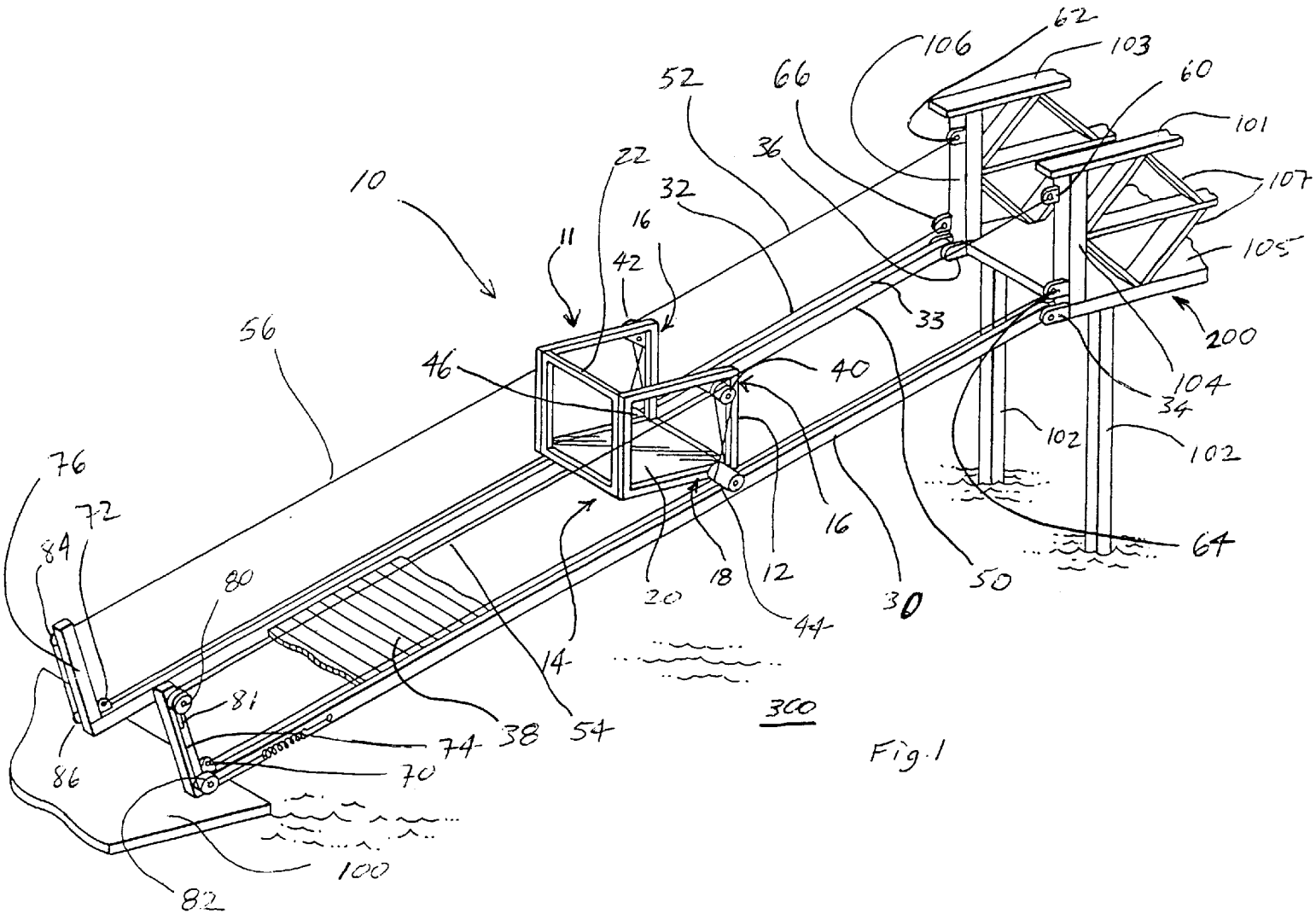
FIG. 1 is a side perspective view of the ramp system of one embodiment of the present invention, shown in use in a marine environment.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The present invention is a ramp system for moving material and people up and down a variably-inclinable ramp in a carriage configured to maintain a generally horizontal orientation. While the invention is contemplated to have a wide variety of applications, the inventor believes that it would have particular usefulness in transporting people in wheelchairs up and down ramps, and the figures herein show the invention employed in a marine environment with a carriage for carrying a wheelchair from a dock to a pier. It is of course not necessary that the ramp system be used only between a dock and a pier as shown but the description hereafter shall refer to this marine embodiment of the invention shown in the drawings for the sake of convenience. Furthermore, it is not necessary that the system be used to transport wheel-chairs; references to wheelchairs herein are only for the sake of illustration. Other wheeled devices such as motorized scooters and walkers could also suitably be transported by the inventive system.

Referring first to FIG. 1, one embodiment of a ramp system constructed in accordance with the principles of the present invention is denoted generally herein by the numeral "10". Ramp system 10 generally provides a ramp between an upper site such as pier 200, and a site having a lower elevation than the upper site, such as floating dock 100.

In the preferred embodiment of the invention, pier 200 extends outwardly from land (not shown) over water 300 and has a fixed elevation, being held up out of the water 300 by a plurality of posts 102, as is well known in the art. Pier 200, as is typical, has a deck 105 and may have railings 101, 103 sitting atop posts 104, 106 situated at the end of pier 200. Cross bracing 107 may extend between deck 105 and railings 101, 103. In these regards, pier 200 is conventional.

Floating dock 100, to which a boat (not shown) might be moored, is also conventional. It will be understood that the elevation of dock 100 is not fixed, unlike the elevation of pier 200, but rather varies according to the level of water 300. The level of water 300 may change, for example, if water 300 is tidal.

The invention provides a first rail 30 and a second rail 32 which extend between pier 200 and dock 100. First rail 30 is pivotally attached at one end to pier 200 at a first lower attachment point 34, which may conveniently be on the lower portion of post 104, and rail 30 extends downwardly to dock 100. Similarly, second rail 32 is pivotally attached at one end to pier 200 at a second lower attachment point 36, which may conveniently be on the lower portion of post 106, and rail 32 also extends downwardly to dock 100. The pivotal attachment of rails 30, 32 allows them to pivot with respect to pier 200 as described in further detail below. Rails 30, 32 may be secured to dock 100 at their opposite ends either in a fixed fashion, or pivotally, but need not necessarily be secured to the dock.

As shown in the figures, when affixed to pier 200 in this manner, rails 30, 32 lie generally parallel to one another. Rails 30, 32 may be provided with decking 38 (shown only in part in FIG. 1) extending between them to form a generally conventional ramp between dock 100 and pier 200 which people may traverse in a traditional manner.

The invention further provides a carriage 11 for carrying a wheelchair (not shown) and its occupant up and down the ramp.

In the preferred embodiment, carriage 11 has a frame 12 comprising, generally, a front portion 14, an upper rear portion 16 (which might be considered to be the upper half and the rear half of the carriage as it sits in its normal, upright orientation) and a lower rear portion 18. Carriage 11 also has a platform 20 upon which a wheelchair may be maneuvered and secured for transport, and a door 22 hinged to frame 12 at front portion 14 to prevent the wheelchair from sliding out of the carriage. A similar door (not shown) may be hinged to frame 12 at the rear of carriage 11. Door 22 may be left in an open position when carriage 11 is not in use, so that people may simply walk through carriage 11 from the dock to the pier.

Carriage 11 is provided at its lower rear portion 18 with a plurality of wheels 24 (shown in detail in FIG. 3) on which carriage 11 is suited to ride along rails 30, 32, and specifically, along upper surfaces 31, 33 of rails 30, 32. In a preferred embodiment, as shown in the figures, there are two wheels 24, one on each side of carriage 11.

As further shown in the drawings, a number of cables extend between pier 200 and carriage 11, and between carriage 11 and dock 100. It is this arrangement of these cables which is one of the particularly noteworthy aspects of the present invention.

In a preferred embodiment of the invention, carriage 11 is provided with four pulleys: a first upper pulley 40 attached to upper rear portion 16 of frame 12 on one side thereof, a second upper pulley 42 attached to upper rear portion 16 of frame 12 on the opposite side thereof; a first lower pulley 44 attached to lower rear portion 18 of frame 12 on one side thereof, and a second lower pulley 46 attached to lower rear portion 18 of frame 12 on the opposite side thereof.

Figure 3:
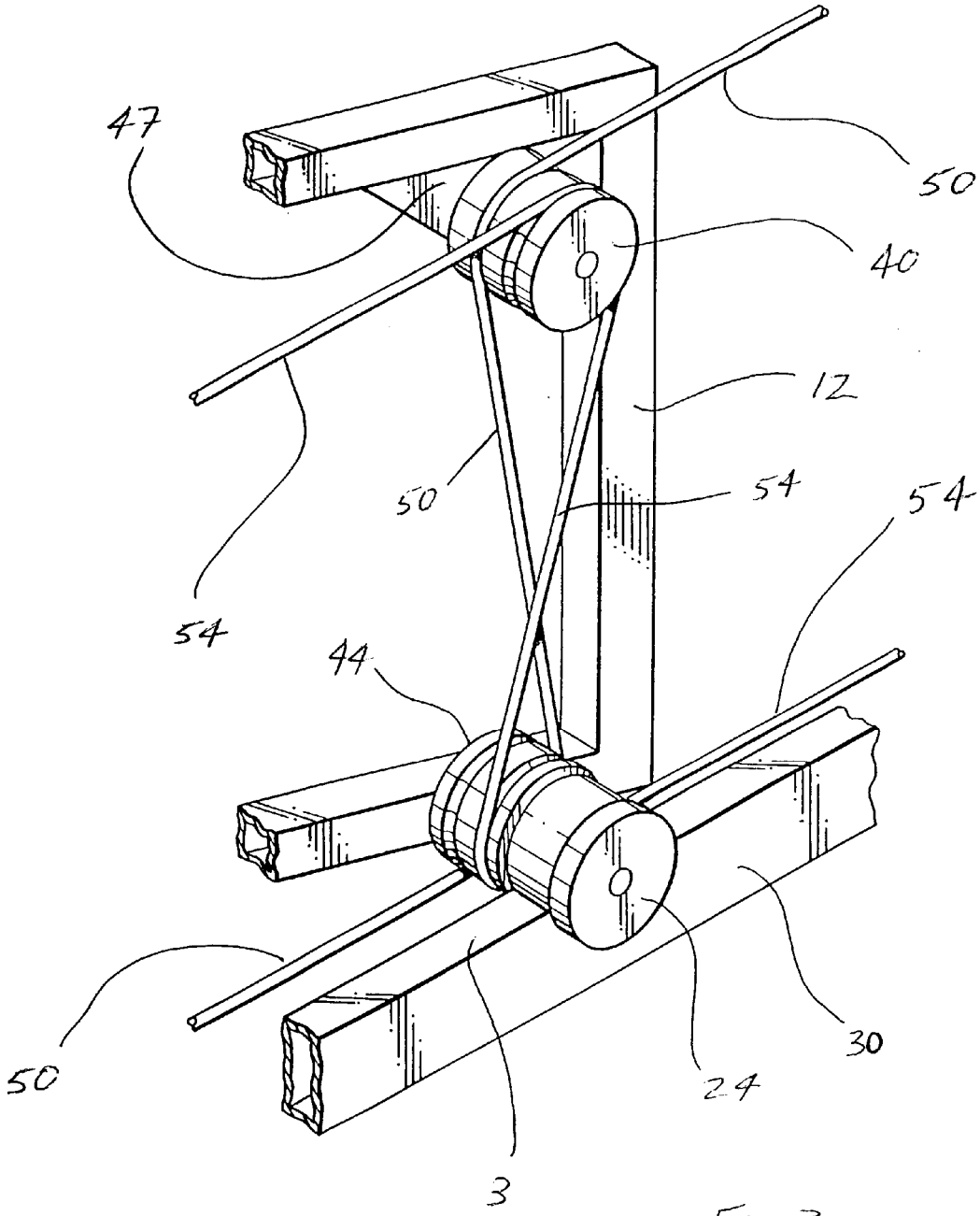
FIG. 3 is a close-up cutaway view of the rear portion of the carriage of the system shown in FIG. 1.

While pulleys 40, 42, 44, 46 may be placed in a variety of locations with respect to frame 12 to allow the proper practice the invention, in the preferred embodiment, as shown in the drawings, the upper pulleys 40, 42 are each attached to a corner brace 47 (FIG. 3) formed in a respective corner of frame 12, and extend outwardly from carriage 11. Further, in the preferred embodiment, lower pulleys 44, 46 may be attached directly to frame 12, and, as shown in FIG. 3, may also be integrated with wheels 24, with pulley 44 extending outwardly from frame 12 as the inner part of wheel 24, as shown in FIG. 3. Most preferably, the centers of lower pulleys 44, 46 are located vertically underneath the centers of upper pulleys 40, 42 when carriage 11 is in a horizontal orientation, as shown in the figures.

Carriage 11 therefore has four pulleys extending outwardly from its rear portion. Associated with each one of these pulleys is at least one cable, and preferably, two cables.

A first cable 50 is attached at one of its ends to a first upper attachment point 60 on pier 200, preferably located on post 104. First cable 50 extends downwardly from attachment point 60 to first upper pulley 40, and passes over the top of it. Cable 50 thereafter passes underneath first lower pulley 44, as shown in FIG. 3. First cable 50 is attached at its other end to an attachment point 70 near the end of rail 30. Attachment point 70 may be on rail 30 itself, as shown in the drawings, or may be on the lower portion of an upwardly extending support member 74 on rail 30. Again, the specific orientation of first cable 50 at first pulleys 40, 44 is shown in detail in FIG. 3.

Preferably, the vertical distance between first upper attachment point 60 and first lower attachment point 34 is such that cable 50, as it extends from first upper attachment point 60 to first pulley 40, is approximately parallel to rail 30, thereby forming a parallelogram between rail 30, cable 50, post 104 and the line between the center of pulley 40 and the center of pulley 44. It will be appreciated that as long as cable 50 is taut, this parallelogram will be maintained notwithstanding the relative position of carriage 11 along rails 30, 32, and notwithstanding the degree of inclination of rails 30, 32.

Similarly, a second cable 52, on the opposite side of carriage 11, is attached at one end to a first upper attachment point 62 on pier 200, preferably on post 106. Second 52 extends downwardly from attachment point 62 to second upper pulley 42, and passes over the top thereof. Passing thereafter underneath second lower pulley 46, second cable 52 is attached at its other end to an attachment point 72 near the end of rail 32. Again, attachment point 72 may be on rail 32, or may be on the lower portion of an upwardly extending support member 76.

It will be appreciated from this description and from the drawings, accordingly, that first cable 50 and second cable 52 are the two "upper cables" between the carriage 11 and pier 200 as shown in the figures, and the two "lower cables" between carriage 11 and dock 100. These two cables, when taut, pull on frame 12 of carriage 11 by pulling on pulleys 40, 42, and 44 and 46 to cantilever carriage 11 into an upright, horizontal orientation when the upper and lower pulleys are vertically aligned. The inventor has determined that this cable arrangement maintains the carriage 11 in an approximately upright, horizontal orientation no matter how far along rails 30, 32 carriage 11 is located, and no matter what the degree of incline is between dock 100 and pier 200.

While it should be clear to those skilled in the art that these two cables alone should be able to maintain carriage 11 in a horizontal orientation, two other cables, cable 54 and 56, are added to the system in a preferred embodiment for further mechanical support, and to prevent carriage 11 from tipping rearwardly towards pier 200.

Specifically, cable 54 is attached at one end to post 104 on pier 200 at some elevation point 64 intermediate first lower attachment point 34 and first upper attachment point 60, and preferably a short vertical distance away from lower attachment point 34. Cable 54 may be attached at an opposite end to an upper portion of upwardly extending support member 74 on rail 30. From pier 200, cable 54 passes underneath pulley 44, then over pulley 40, as shown in detail in FIG. 3. Again, the attachments points of cable 54 should be such as to maintain cable 54 in a generally parallel relation to rail 30.

A fourth cable 56 similarly passes between pier 200 and rail 32 on the opposite side of carriage 11, passing under pulley 46 and over pulley 42, and may be attached to upwardly extending support member 76 on rail 32 at intermediate elevation point 66.

Figure 2:
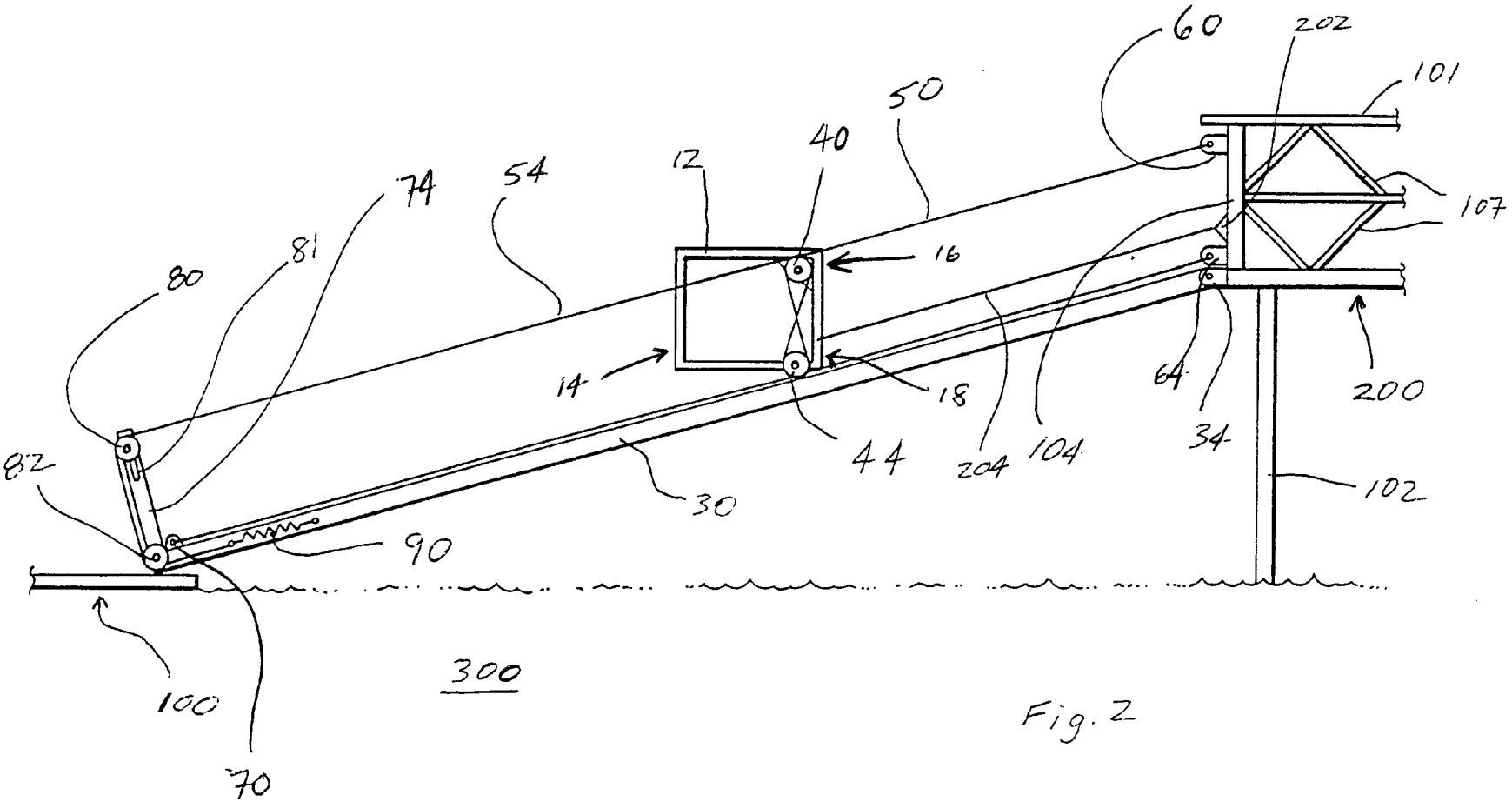
FIG. 2 is a side view of the ramp system shown in FIG. 1.

In one embodiment of the invention, as shown in the figures, at its lower end cable 54 may pass over a series of two pulleys 80, 82 attached to upwardly extending support member 74, and have this end attached to a spring 90 which is in turn attached to rail 30, as shown in FIG. 2. Pulley 80 may be spring loaded to urge cable 54 upwardly, and may ride within slot 81 in support member 74. The action of spring 90 and spring-loaded pulley 80 helps to keep cable 54 taut. The same system may be employed for cable 56, with pulleys 84, 86. It will further be recognized that a similar attachment system could be employed at the opposite, pier end, of the ramp. Alternatively, or used concurrently, other means for adjusting the length of the cables may be added to the system. Such adjustment means might be useful, for example, for taking up slack from the cables due to the natural stretching thereof. An example of such means which could be provided would be the addition of turnbuckles (not shown) between the ends of the cables and their respective attachment points.

It will be appreciated that the afore described system allows carriage 11 to be moved between a first, lower position at dock 100, along rails 30, 32 to a second, upper position at pier 200, while maintaining carriage 11 in a generally horizontal orientation. The particular arrangement of the system's pulleys and cables allows the carriage's generally horizontal orientation to be maintained through a wide range of degrees of inclination of the ramp.

While carriage 11 may be moved by hand, the system 10 is preferably provided with motorized motive means for moving carriage 11 along rails 30, 32 from dock 100 to pier 200. Specifically, the carriage 11 may be self-propelled, having a motor which turns one or more of pulleys 40, 42, 44 or 46, or may more simply be attached to a winch at pier 200 by a cable. FIG. 2 shows, in a schematic manner, a winch 202 attached to post 104, bearing a cable 204 which is attached at one end to carriage 11. Such a winch could also just as conveniently be incorporated into the carriage 11. It is accordingly contemplated by the inventor that a wide variety of motive means might be usefully employed in the operation of the system 10.

In operation, when a wheelchair-bound person wishes to be transported from dock 100 to pier 200, carriage 11 is moved to its lower position, with platform 20 resting on the surface of dock 100. This position may indeed be considered the carriage's "default", or resting position, since in this position it is easy for people to walk through carriage 11 and to traverse the ramp in a traditional fashion on foot. Once carriage is in position, door 22 is opened, and the wheelchair is maneuvered onto platform 20 and secured within the confines of carriage 11. Once the wheelchair is secured, the carriage 11 is moved by the appropriate motive means upwardly along rails 30, 32 to an upper position, where platform 20 lies roughly at the same elevation as deck 105 of pier 200. The rear door (if carriage 11 has one), is opened, and the wheelchair is unsecured from carriage 11, and the wheelchair user is then able to proceed onto pier 200. Transporting the wheelchair from pier 200 to dock 100 is simply the reverse of this process.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A ramp system for transporting material between a first site and a second site, said first site having a lower elevation than said second site, the system comprising:

a) first and second rails extending between said first and second sites, said first and second rails pivotally attached at one end to said second site at first and second lower attachment points respectively, each rail bearing an upwardly extending support member near its opposite end;

b) a carriage for carrying said material, said carriage having a frame comprising a front portion, a lower rear portion and an upper rear portion;

c) a plurality of wheels attached to said lower rear portion of said carriage for engaging said rails;

d) a first upper pulley attached to said upper rear portion of said frame on one side thereof, and a second upper pulley attached to said upper rear portion of said frame on the opposite side thereof;

e) a first lower pulley attached to said lower rear portion of said frame on one side thereof, and a second lower pulley attached to said lower rear portion of said frame on the opposite side thereof;

f) a first cable attached at one end to a first upper attachment point on said second site, said first upper attachment point located at a higher elevation than said first lower attachment point, said first cable attached at an opposite end to the bottom portion of said support member on said first rail, said first cable extending from said first upper attachment point over said first upper pulley and under said first lower pulley;

g) a second cable attached to a second upper attachment point on said second site, said second upper attachment point located at a higher elevation than said second lower attachment point, said second cable attached at an opposite end to the bottom portion of said support member on said second rail, said second cable extending from said second upper attachment point over said second upper pulley and under said second lower pulley; and h) means for providing motive force to said carriage to move it up and down said rails between said first and second sites.

2. A ramp system as claimed in claim 1, wherein said motive means comprises a motor associated with a plurality of said wheels.

3. A ramp system as claimed in claim 1 further comprising:

a) a third cable attached at one end to said second site at an elevation intermediate said first lower attachment point and said first upper attachment point, and attached at an opposite end to said support member on said first rail; said third cable passing from said second site underneath said first lower pulley and over said first upper pulley; and b) a fourth cable attached at one end to said second site at an elevation intermediate said second lower attachment point and said second upper attachment point, and attached at an opposite end to said support member on said second rail; said fourth cable passing from said second site underneath said second lower pulley and over said second upper pulley.

4. A ramp system as claimed in claim 3, wherein said carriage has two wheels, one on each side thereof, and said lower pulleys are integral with said wheels.

5. A ramp system as claimed in claim 4, wherein said carriage further comprises a door at its front portion, hinged to said frame.

6. A ramp system as claimed in claim 5, further comprising decking passing laterally between said first and second rails to allow people to walk therebetween.

7. A ramp system as claimed in claim 1, wherein said motive means comprises a winch having a cable attached to said carriage.

8. A ramp system as claimed in claim 1, wherein said motive means comprises a motor associated with one of said wheels.

9. A ramp system as claimed in claim 1 further comprising:

a) a third cable attached at one end to said second site at an elevation intermediate said first lower attachment point and said first upper attachment point, and attached at an opposite end to said first rail; said third cable passing from said second site underneath said first lower pulley and over said first upper pulley, then over an upper pulley on said support member, then under a lower pulley on said support member; and b) a fourth cable attached at one end to said second site at an elevation intermediate said second lower attachment point and said second upper attachment point, and attached at an opposite end to said support member on said second rail; said fourth cable passing from said second site underneath said second lower pulley and over said second upper pulley, then over an upper pulley on said support member, then under a lower pulley on said support member.

10. A ramp system as claimed in claim 9, wherein said carriage has two wheels, one on each side thereof, and said lower pulleys are integral with said wheels.

* * * * *